US007950338B2

(12) United States Patent
Smed

(10) Patent No.: US 7,950,338 B2
(45) Date of Patent: May 31, 2011

(54) ADJUSTABLE HEIGHT KEYBOARD SUPPORT

(75) Inventor: Ole Falk Smed, Calgary (CA)

(73) Assignee: Trade Management Group Limited, Denver, CO (US)

( * ) Notice: Subject to any disclaimer, the term of this patent is extended or adjusted under 35 U.S.C. 154(b) by 540 days.

(21) Appl. No.: 12/028,957

(22) Filed: Feb. 11, 2008

(65) Prior Publication Data

US 2009/0200437 A1 Aug. 13, 2009

(51) Int. Cl.
*A47B 3/02* (2006.01)

(52) U.S. Cl. ..... 108/119; 108/145

(58) Field of Classification Search ..... 108/145, 108/147.22, 4, 99, 116–120; 248/164, 439, 248/166, 918, 121; 312/208.1
See application file for complete search history.

(56) References Cited

U.S. PATENT DOCUMENTS

| | | | | | |
|---|---|---|---|---|---|
| 78,250 | A * | 5/1868 | Withey | 108/116 |
| 148,329 | A * | 3/1874 | Sheaffer | 108/99 |
| 316,363 | A * | 4/1885 | Hough | 108/116 |
| 349,974 | A * | 9/1886 | Bennett | 108/93 |
| 1,318,564 | A * | 10/1919 | Jenkins | 108/145 |
| 4,032,103 | A * | 6/1977 | Ehrichs | 248/421 |
| 4,296,694 | A * | 10/1981 | Kobayashi | 108/116 |
| 4,384,533 | A * | 5/1983 | Lehrman | 108/117 |
| 4,993,706 | A * | 2/1991 | Wilkinson | 482/142 |
| 6,306,066 | B1 * | 10/2001 | Yang | 482/68 |
| 7,048,236 | B2 | 5/2006 | Benden et al. | 248/121 |

* cited by examiner

*Primary Examiner* — Janet M Wilkens
(74) *Attorney, Agent, or Firm* — Amy Allen Hinson; Nexsen Pruet, LLC

(57) ABSTRACT

A vertically adjustable keyboard support is mounted on a pair of U-shaped members having crossed legs pivoted on a horizontal axis providing scissor linkage support for adjusting the height of the keyboard to accommodate the keyboard operator in a standing position as well as in a sitting position.

14 Claims, 6 Drawing Sheets

ADJUSTABLE HEIGHT KEYBOARD SUPPORT

BACKGROUND OF THE INVENTION

This invention relates to a work station keyboard support elevation apparatus which permits a person using a keyboard, or a mouse, to adjust the keyboard to heights satisfactory for persons working in seated or standing positions. Workers are often required to perform tasks in a sitting position at a work station, which reduces blood flow through the legs and induces worker fatigue. The herein disclosed keyboard support is readily adjustable by the worker to an elevated position allowing the worker to work in a standing position. It is also easily adjusted back to a suitable worker sitting position. Monitor supports have previously been provided by which the monitor height can be adjusted and some monitor supports permit the monitor to be tilted about a horizontal axis parallel to the face of the monitor. These adjustments facilitate use of the monitor while the worker is standing but do not elevate a counter supported keyboard to a convenient height for the standing worker.

BRIEF SUMMARY OF THE INVENTION

The herein disclosed vertically adjustable keyboard support includes a horizontal base plate adapted to rest flat on a desk top or work station counter and an upper horizontal keyboard support plate. The adjustable keyboard support is a stand alone portable item. It need not be attached to adjacent structure. The upper keyboard support plate is interconnected to the horizontal base plate by a scissor linkage leg structure permitting keyboard height adjustment for various height persons when either in a sitting position or a standing position. The scissors linkage support structure includes a pair of U-shaped components, each having a pair of legs with proximal ends extending from, and rigidly secured to, a horizontal tie bar. Corresponding legs of the two U-shaped components are interconnected intermediate their ends on a common horizontal axis to form a pair of scissors support linkages. The tie bar of one of the U-shaped components is pivotally connected on a horizontal axis to the underside of the keyboard support plate near one of its fore and aft edges. Parallel ridges on the underside of the keyboard support plate provide a plurality of horizontally spaced notches which are releasably and individually engageable by the tie bar of the other U-shaped component to provide a wide range of height adjustment for the keyboard support plate.

DESCRIPTION OF THE DRAWINGS

The invention is illustrated in the accompanying drawings, in which.

DETAILED DESCRIPTION OF THE DRAWINGS

Figure 1:
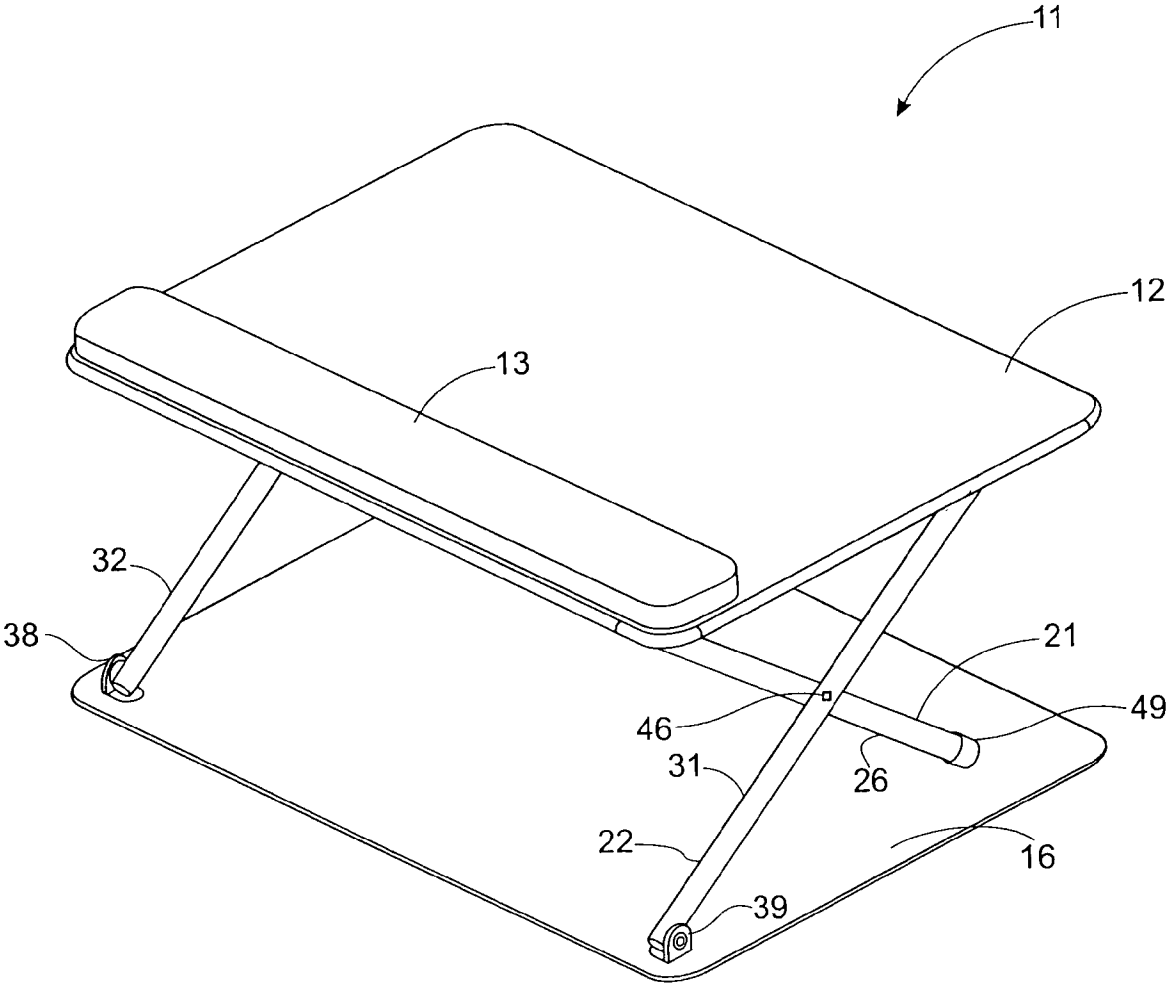
FIG. 1 is a perspective of one embodiment of the invention.
Figure 3:
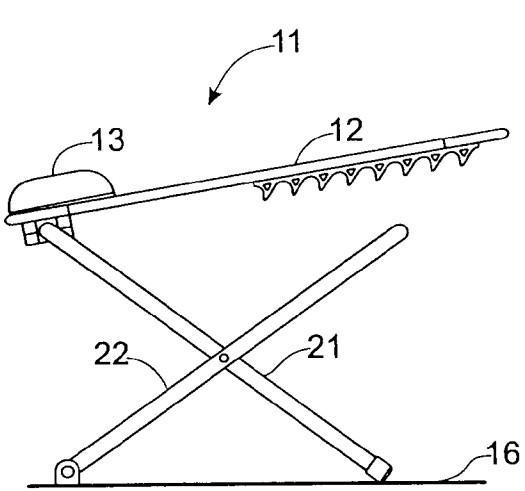
FIG. 3 shows the tie bar of one set of legs disconnected from notches on the underside of the upper keyboard support plate.
Figure 4:
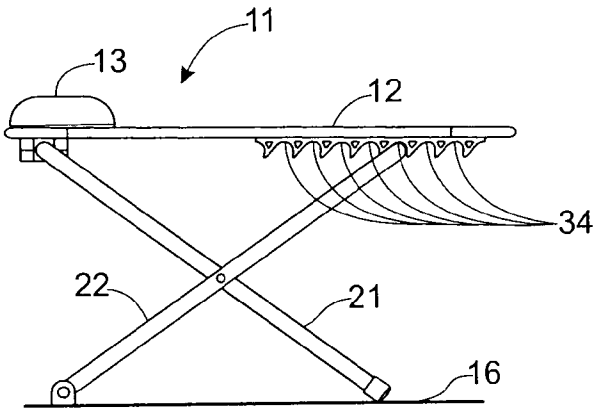
FIG. 4 shows the keyboard support plate adjusted to an intermediate height position.
Figure 8:
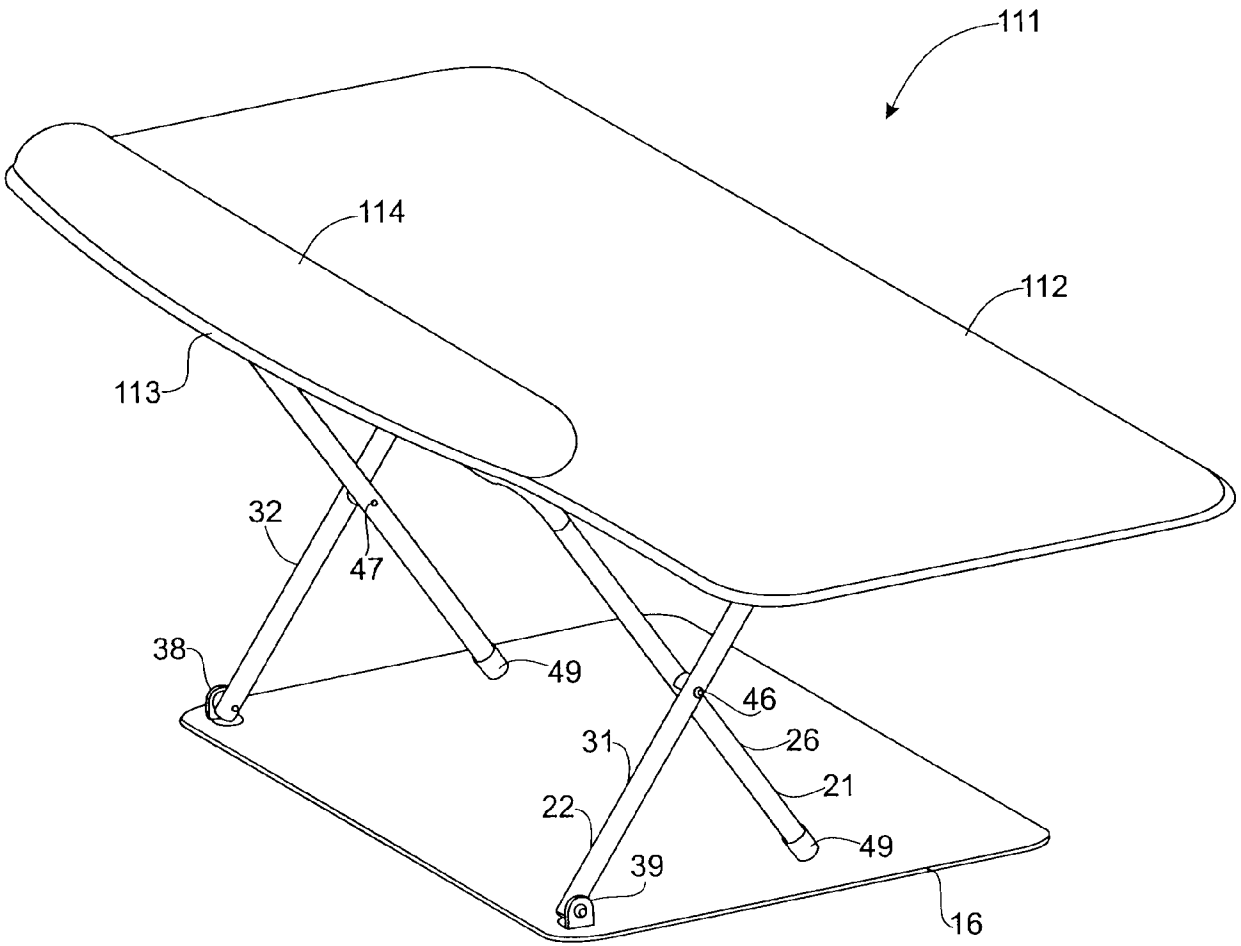
FIG. 8 is a perspective of a second embodiment of the invention.
Figure 10:
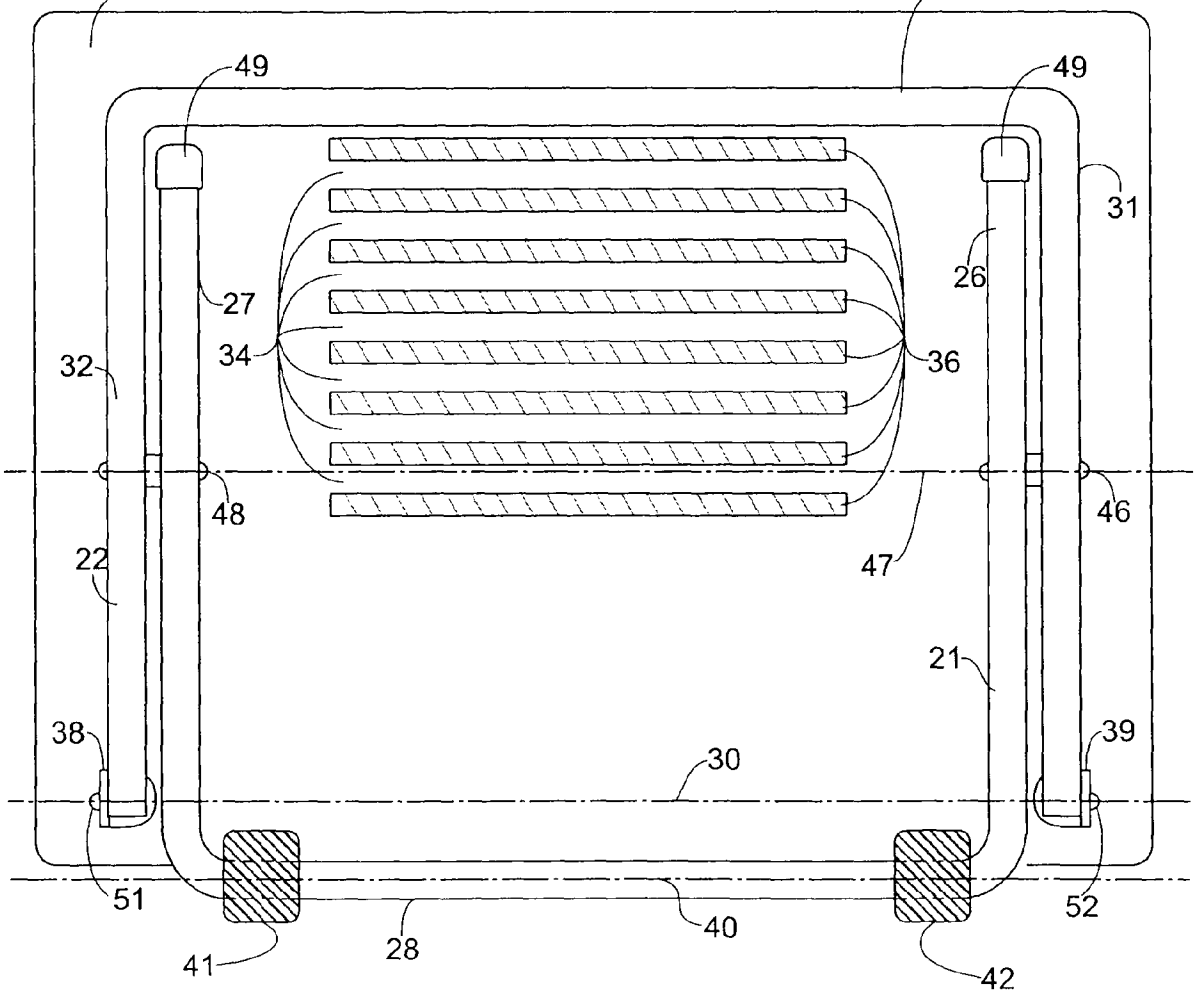
FIG. 10 is a section taken on the line 10-10 in FIG. 5.

Referring particularly to FIGS. 1, 4 and 10, the keyboard support structure 11 includes a rigid quadrilateral or rectangular shaped keyboard support plate 12 with rounded edges which may be molded or formed from a suitable strong rigid uniform thickness material. An elongated arm rest 13 made of a soft material is secured to the top of the keyboard support plate 12 adjacent its rear edge. The upper keyboard support plate 12 is connected by a scissors linkage structure to a lower or bottom horizontal support plate 16 of a quadrilateral or rectangular shape formed from a suitable sheet of thin material of uniform thickness. The bottom support plate 16 may have the same lateral side to side width as the keyboard support plate 12 and its front to rear dimension may be the same as the front to rear dimension of the keyboard support plate 12, however, in the keyboard support structure 111 shown in FIG. 8 an upper keyboard support plate 112 extends laterally beyond one lateral edge of the lower support plate 16; and its rear edge 113 and its arm resting pad 114 are horizontally curved slightly toward the user.

The scissors linkage support includes a pair of U-shaped leg structures 21, 22 interposed between the upper and lower plates 12, 16. The leg structure 21 includes a pair of parallel legs 26, 27 rigidly interconnected by a horizontal connector 28 which is pivotally connected to the underside of the upper support plate 12 on a horizontal axis 40. The leg structure 22 includes a pair of parallel legs 31, 32 and a horizontal connector 33 between and rigidly connected to the upper ends of the legs 31, 32. A pivot pin 46 pivotally connects legs 21 and 31 on a horizontal axis 47 and a pivot pin 48 pivotally interconnects legs 27, 32 on the axis 47. The horizontal connector 33 is adapted for insertion into downwardly open equally spaced parallel notches 34 formed by parallel ridges 36 of a releasable retention structure or mat 37 rigidly secured to the underside of the upper plate 12. The axes 40, 47 are parallel to the notches 34. Cups 49 made of elastic anti skid material are mounted on the lower ends of the legs 26, 27, 31, 32.

Figure 9:
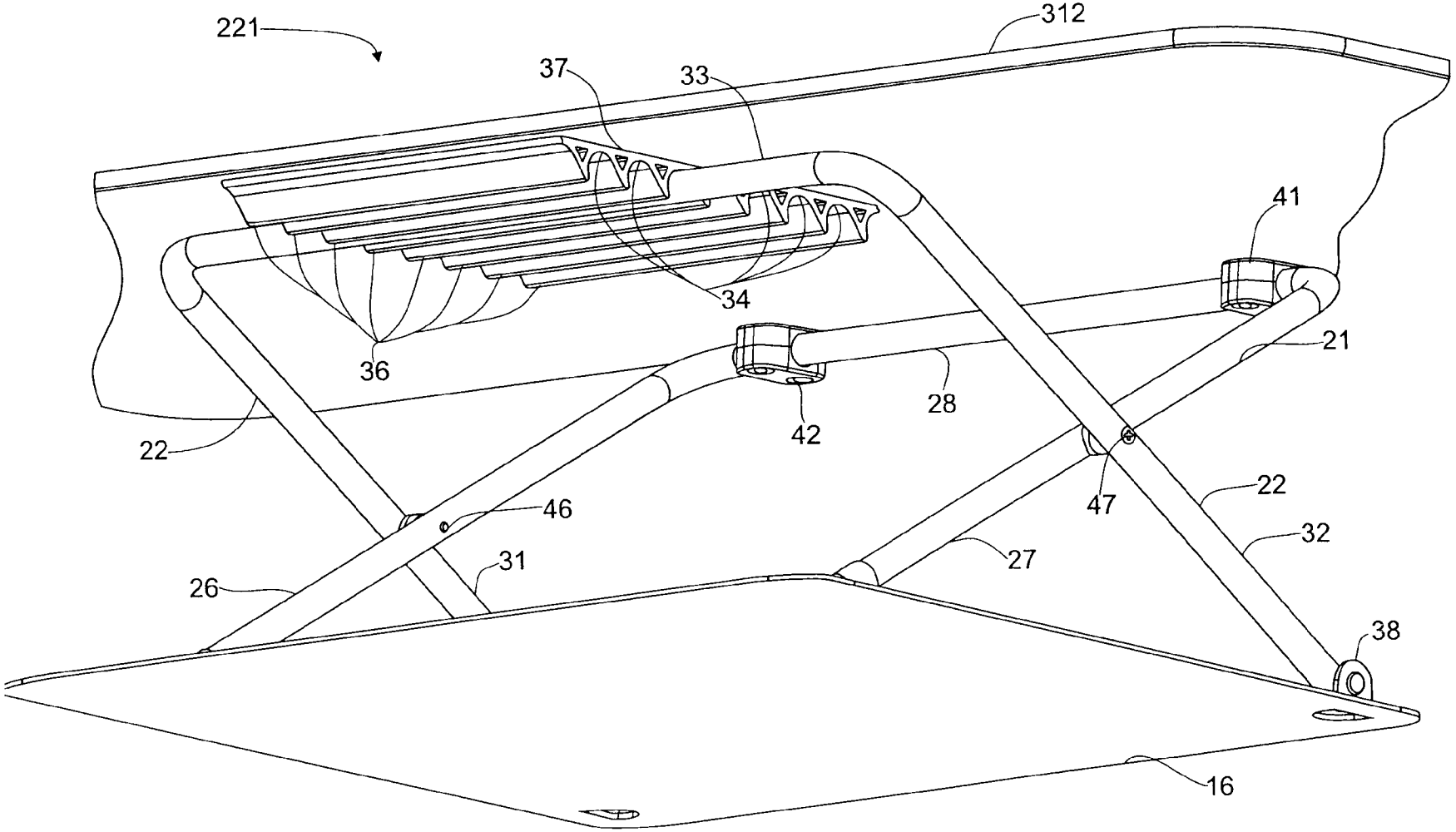
FIG. 9 is a perspective of a third embodiment of the invention.

The U-shaped leg structures 21, 22 are hollow, have substantially equal length legs and are preferably formed from aluminum tubing or the like. The horizontal connector 28 of the U-shaped structure 21 is pivotally connected to the rear underside of the upper plate 12 on a horizontal axis 40 by a pair of pivot blocks 41, 42. The lower ends of the legs 31, 32 are pivotally connected by pivot pins 51, 52 to upturned vertical tabs 38, 39 of the lower plate 16 on a horizontal axis 30. The long grooves 34 of the releasable connector formed by the mat 37 provide a stable connection with the cylindrical connector 33. FIG. 9 illustrates an adjustable keyboard support 221 which has a keyboard support plate 312 extending laterally beyond both lateral edges of the lower support plate 16.

Figure 2:
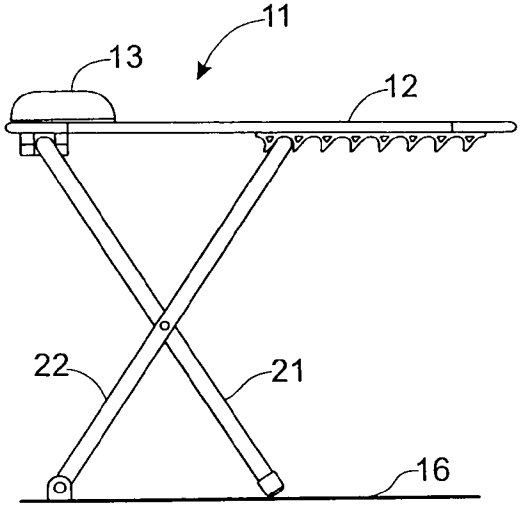
FIG. 2 is a side view showing the keyboard support structure of FIG. 1 in its highest adjusted position.
Figure 5:
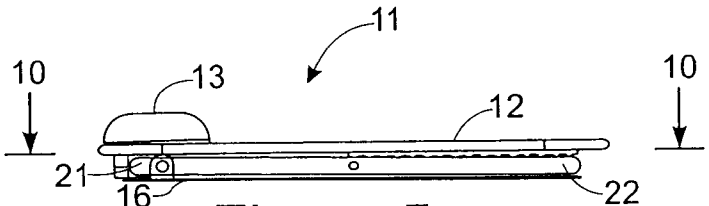
FIG. 5 shows the keyboard support plate adjusted to its lowest height position.
Figure 7:
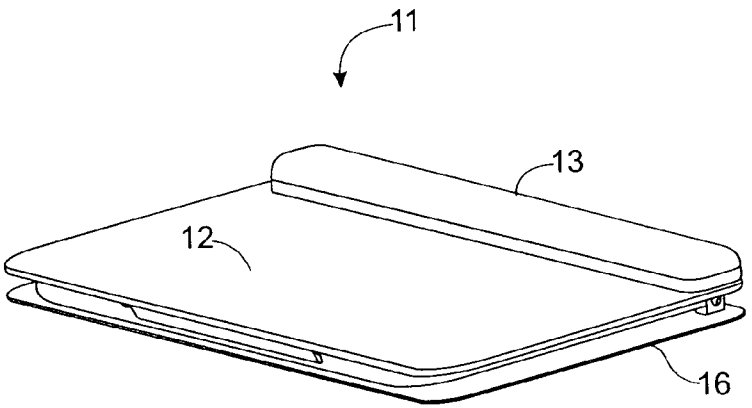
FIG. 7 shows the keyboard support structure in its collapsed position of adjustment.
Figure 6:
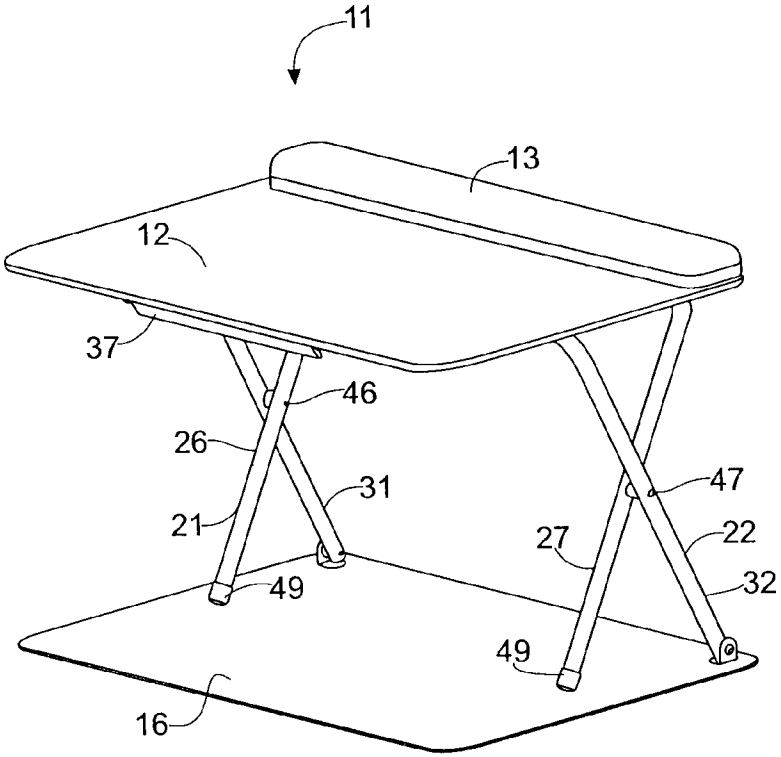
FIG. 6 is a perspective showing the keyboard support plate in its highest position of adjustment.

In the illustrated embodiments of the invention the upper and lower plates 12, 16 remain parallel in all positions of height adjustment. The low collapsed height shown in FIG. 7 facilitates use of the keyboard support structure when the user is in a sitting position. The upper plate 12 can easily be lifted relative to the lower plate 16 and the legs 21, 22 adjusted between the highest height position shown in FIG. 2 and the collapsed position shown in FIG. 5. In the collapsed position the upper keyboard support plate and the lower support plate are separated by a distance approximately the thickness of a leg. The nested position of the U-shaped structures 21, 22 is made possible by making the distance between the connector 33 and the pivot axis 47 greater than the distance between the axis 47 and the ends of the legs 26, 27 of the U-shaped structure 21. The upper plate 12 is in a horizontal position in all positions of height adjustment. In the next to lowest position of adjustment the upper plate is only one and three-fourth inches above the supporting desk or work counter. The lower positions of adjustment are useful for adjusting the height of the keyboard support plate 12 to a comfortable working height for tall people in their sitting positions; however, the outstanding attribute of the illustrated keyboard support is its upper range of height adjustment permitting persons of various heights to work efficiently in a standing position.

What is claimed is:

1. A keyboard support comprising:

a bottom horizontal support plate having front, rear and side edges defining a quadrilateral shape, an upper horizontal keyboard support plate having front, rear and side edges defining a quadrilateral shape, a first pair of parallel legs having first corresponding ends secured on a first horizontal axis to the underside of said upper support plate near its rear edge and second corresponding ends adapted to rest on the top of said bottom plate wherein said first corresponding ends of said first parallel legs are rigidly interconnected by a transverse member pivotally connected to the underside of said upper support plate, a releasable retention structure positioned on the underside near said front edge of said upper support plate and formed from a mat with horizontally spaced parallel rows of downwardly open notches, and a U shaped leg structure including a second pair of parallel legs having first corresponding ends pivotally connected to the upper side of said bottom support plate near its rear edge on a second horizontal axis and second corresponding ends rigidly interconnected by a horizontal connector adapted to releasably fit in a selected one of said plurality rows of notches, said first and second pairs of legs being pivotally interconnected intermediate their ends on a third horizontal axis, said horizontal axes being parallel to one another.

2. The keyboard support structure of claim 1 wherein said horizontal connector is cylindrical.

3. The keyboard support of claim 1 wherein said U-shaped leg structure is tubular.

4. They keyboard support of claim 1 wherein said keyboard support is adjustable to a collapsed position in which said plates are parallel and vertically separated a distance approximately the thickness of one of said legs.

5. The keyboard support structure of claim 1 wherein said first parallel legs and said transverse member form a U-shaped member.

6. The keyboard support structure of claim 5 wherein said releasable retention structure includes a plurality of parallel ridges extending downwardly from the underside of said upper support plate and forming said notches.

7. The keyboard support structure of claim 6 wherein said transverse member is tubular and is pivotally connected on said first parallel axis.

8. The keyboard support structure of claim 5 wherein said keyboard support structure has a collapsed position of adjustment in which said U-shaped leg structure and said U-shaped member have a nested relationship.

9. The keyboard support structure of claim 1 wherein said upper support plate extends laterally beyond said lower support plate.

10. The keyboard support structure of claim 1 wherein said releasable retention structure is positioned at the mid-line between said side edges of said upper support plate.

11. A keyboard support comprising:

a thin flat upper horizontal keyboard support plate having a front edge, a rear edge and a pair of laterally opposite side edges, a thin flat lower horizontal support plate having a front edge, a rear edge and a pair of laterally opposite side edges, first and second U-shaped tubular leg structures each of which have a pair of equal length legs extending from opposite ends, respectively, of a cylindrical horizontal connector, said cylindrical horizontal connector of said first U-shaped tubular leg structure being pivotally connected on a first horizontal axis to the underside of said upper support plate parallel to and near its rear edges, the distal ends of said legs of said second U-shaped structure being pivotally connected to the top side of said lower support plate near its rear edge on a second horizontal axis, said legs of one of said U-shaped structures being positioned laterally inward of and adjacent to the legs of the other U-shaped structure and pivotally connected thereto intermediate their ends on a horizontal axis, and a releasable connector positioned on the underside and at the mid-line between said side edges of said upper plate and formed from a mat with a plurality of laterally extending parallel grooves spaced from one another in a front to rear direction relative to said upper plate for selective releasably engagement by the cylindrical horizontal connector of said second U-shaped tubular leg structure so as to establish the elevation of said upper plate relative to said lower plate.

12. The keyboard support structure of claim 11 wherein said releasable connector is positioned near said front edge of said upper plate.

13. A keyboard support comprising:

a bottom horizontal support plate having front, rear and side edges defining a quadrilateral shape, an upper horizontal keyboard support plate having front, rear and side edges defining a quadrilateral shape, a first pair of parallel legs having first corresponding ends secured on a first horizontal axis to the underside of said upper support plate near its rear edge and second corresponding ends adapted to rest on the top of said bottom plate, a releasable retention structure on the underside of said upper support plate and positioned at the mid-line between said side edges of said upper support plate and formed from a mat with horizontally spaced parallel rows of downwardly open notches, and a U shaped leg structure including a second pair of parallel legs having first corresponding ends pivotally connected to the upper side of said bottom support plate near its rear edge on a second horizontal axis and second corresponding ends rigidly interconnected by a horizontal connector adapted to releasably fit in a selected one of said plurality rows of notches, said first and second pairs of legs being pivotally interconnected intermediate their ends on a third horizontal axis, said horizontal axes being parallel to one another.

14. The keyboard support structure of claim 13 wherein said releasable retention structure is positioned near said front edge of said upper support plate.

* * * * *